US005758503A

United States Patent [19]

DuBell et al.

[11] Patent Number: 5,758,503

[45] Date of Patent: Jun. 2, 1998

[54] GAS TURBINE COMBUSTOR

[75] Inventors: Thomas L. DuBell, Palm Beach Gardens; William T. Wisinski, Singer Island; John R. Herrin, West Palm Beach, all of Fla.

[73] Assignee: United Technologies Corporation, Hartford, Conn.

[21] Appl. No.: 434,077

[22] Filed: May 3, 1995

[51] Int. Cl.[6] ..... F23R 3/06

[52] U.S. Cl. ..... 60/752

[58] Field of Search ..... 60/752, 753, 754, 60/757

[56] References Cited

U.S. PATENT DOCUMENTS

| | | | |
|---|---|---|---|
| 4,071,194 | 1/1978 | Eckert et al. | 239/127.3 |
| 4,422,300 | 12/1983 | Dierberger et al. | 60/757 |
| 4,566,280 | 1/1986 | Burr | 60/757 |
| 4,695,247 | 9/1987 | Enzaki et al. | 431/352 |
| 5,000,005 | 3/1991 | Kwan et al. | 60/757 |
| 5,209,059 | 5/1993 | Ward | 60/261 |
| 5,216,886 | 6/1993 | Ewing | 60/752 |
| 5,307,637 | 5/1994 | Stickles et al. | 60/756 |
| 5,328,331 | 7/1994 | Bunker et al. | 416/96 R |
| 5,333,443 | 8/1994 | Halila | 60/39.31 |
| 5,363,643 | 11/1994 | Halila | 60/39.31 |
| 5,435,139 | 7/1995 | Pidcock et al. | 60/752 |

*Primary Examiner*—Michael Koczo
*Attorney, Agent, or Firm*—Richard D. Getz

[57] ABSTRACT

A combustor for a gas turbine engine is provided which includes a plurality of liner segments and a support shell. Each liner segment includes a panel, a forward wall, a trailing wall, a pair of side walls, and a plurality of mounting studs. The panel includes a face surface and a back surface. The forward wall is positioned along a forward edge of the panel and the trailing wall is positioned along a trailing edge of the panel. The side walls connect the forward and trailing walls. The forward, trailing, and side walls extend out from said back surface a particular distance. The plurality of mounting studs extend out from the back surface, and each includes liner segment attachment apparatus.

4 Claims, 1 Drawing Sheet

GAS TURBINE COMBUSTOR

BACKGROUND OF THE INVENTION

1. Technical Field

This invention relates to combustors for gas turbine engines in general, and to double wall gas turbine combustors in particular.

2. Background Information

Gas turbine engine combustors are generally subject to high thermal loads for prolonged periods of time. To alleviate the accompanying thermal stresses, it is known to cool the walls of the combustor. Cooling helps to increase the usable life of the combustor components and therefore increase the reliability of the overall engine.

In one cooling embodiment, a combustor may include a plurality of overlapping wall segments successively arranged where the forward edge of each wall segment is positioned to catch cooling air passing by the outside of the combustor. The forward edge diverts cooling air over the internal side, or "hot side", of the wall segment and thereby provides film cooling for the internal side of the segment. A disadvantage of this cooling arrangement is that the necessary hardware includes a multiplicity of parts. A person of skill in the art will recognize that there is considerable value in minimizing the number of parts within a gas turbine engine, not only from a cost perspective, but also for safety and reliability reasons. Specifically, internal components such as turbines and compressors can be susceptible to damage from foreign objects carried within the air flow through the engine.

A further disadvantage of the above described cooling arrangement is the overall weight which accompanies the multiplicity of parts. A person of skill in the art will recognize that weight is a critical design parameter of every component in a gas turbine engine, and that their is considerable advantage to minimizing weight wherever possible.

In other cooling arrangements, a twin wall configuration has been adopted where an inner wall and an outer wall are provided separated by a specific distance. Cooling air passes through holes in the outer wall and then again through holes in the inner wall, and finally into the combustion chamber. An advantage of a twin wall arrangement compared to an overlapping wall segment arrangement is that an assembled twin wall arrangement is structurally stronger. A disadvantage to the twin wall arrangement, however, is that thermal growth must be accounted for closely. Specifically, the thermal load in a combustor tends to be non-uniform. As a result, different parts of the combustor will experience different amounts of thermal growth, stress, and strain. If the combustor design does not account for non-uniform thermal growth, stress, and strain, then the usable life of the combustor may be negatively affected.

What is needed, therefore, is a combustor for a gas turbine engine which can accommodate a non-uniform thermal load, one that minimizes weight, and one that has a minimal number of parts.

DISCLOSURE OF THE INVENTION

It is, therefore, an object of the present invention to provide a combustor for a gas turbine engine that can accommodate a non-uniform heat load.

It is another object of the present invention to provide a lightweight combustor for a gas turbine engine.

It is still another object of the present invention to provide a combustor for a gas turbine engine with a minimal number of parts.

It is still another object of the present invention to provide a combustor for a gas turbine engine that is inexpensive to manufacture.

It is still another object of the present invention to provide a combustor for a gas turbine engine that requires minimal cooling airflow.

It is still another object of the present invention to provide a combustor for a gas turbine engine with improved maintainability.

According to the present invention a combustor for a gas turbine engine is provided which includes a plurality of liner segments and a support shell. The support shell includes an interior and an exterior surface, a plurality of mounting holes, and a plurality of second coolant holes extending through the support shell. Each liner segment includes a panel, a forward wall, a trailing wall, a pair of side walls, and a plurality of mounting studs. The panel includes a face surface and a back surface, and a plurality of first coolant holes extending therethrough. The forward wall is positioned along a forward edge of the panel and the trailing wall is positioned along a trailing edge of the panel. The side walls connect the forward and trailing walls. The forward, trailing, and side walls extend out from the back surface a particular distance. The plurality of mounting studs extend out from the back surface, and each includes fastening means. The liner segments are attached to the interior of the support shell by the mounting studs, which extend through the mounting holes, and the fastening means. The walls space the panel a distance away from the support shell and seal the gap between the panel and the support shell.

According to one embodiment of the present invention, a rib is provided extending out of the back surface of the panel for structural support.

According to another embodiment of the present invention, a forward flange and a trailing flange are provided to minimize disruptions in film cooling fluid paths between adjacent liner segments.

According to an aspect of the present invention, the panel, walls, and mounting studs of each liner segment are integrally cast as a one piece unit.

An advantage of the present invention is its ability of accommodate a non-uniform heat load. The liner segment and support shell construction of the present invention permits thermal growth commensurate with whatever thermal load is present in a particular area of the combustor. Clearances between segments permit the thermal growth without the binding that contributes to mechanical stress and strain. The forward and trailing flanges of each segment further enhance the present invention's ability to accommodate non-uniform heat loads by minimizing disruptions in the film cooling between the spaced apart liner segments.

The enhanced cooling of the support shell and liner segment construction is a further advantage of the present invention. The support shell and liner construction minimizes thermal gradients across the support shell and/or liner segments, and therefore thermal stress and strain within the combustor. The support shell and liner segment construction also minimizes the volume of cooling airflow required to cool the combustor. A person of skill in the art will recognize that it is a distinct advantage to minimize the amount of cooling airflow devoted to cooling purposes.

A still further advantage of the present invention is that the wall and panel elements of the liner segments facilitate the uniform cooling of the combustor. Air passing through the support shell under a particular liner segment is directed up through the panel of that segment, cooling the panel as it passes through. If air entering under a particular segment were allowed to pass under adjacent liners it would not cool the panel of the segment it entered under as efficiently. The present invention therefore promotes uniform cooling of the combustor.

A still further advantage of the present invention is that a lightweight combustor is provided for a gas turbine engine. Each liner segment is cast to facilitate manufacture and to minimize weight. The elements of each liner segment, including the panel, and walls and mounting studs extending out from the panel, draw mechanical strength from being integrally formed with one another. The therefore greater structural integrity of each cast liner segment enables material normally required in the individual elements to be eliminated and the weight consequently reduced.

A still further advantage of the present invention is that a combustor for a gas turbine engine is provided with a minimal number of parts. Some combustor designs require a multiplicity of independent nuts and bolts to secure the walls of a twin wall combustor together. In addition, some twin wall combustor designs require a multiplicity of spacers be fixed between the walls to consistently space the walls apart from one another. A disadvantage of these approaches is that they increase the chance that a spacer, bolt, or nut can work free and cause foreign object damage downstream within the engine. This is particularly true if the object works free on the "hot side" of the combustor where it is more likely to be ingested into a downstream turbine or compressor. The liner segments of the present invention, on the other hand, have integrally formed studs for attachment and walls for spacing. The only additional hardware necessary is the means for fastening the studs on the exterior, or "cold side" of the combustor. In short, the present invention reduces the number of independent parts within the combustor, and therefore reduces the number of parts that potentially could become free within the engine and cause damage.

A still further advantage of the present invention is that the combustor is inexpensive to manufacture and assemble. The twin wall configuration of the present invention requires a plate-like support shell with holes for receiving the liner segment studs and holes for coolant, and a plurality of formed liner segments for attachment to the support shell. The support shell of the present invention is a simple cost effective design which does not require attachment of spacers. Similarly, the liner segments are designed to be inexpensively cast and easily attached to the support shell.

A still further advantage of the present invention is that the support shell and liner segment construction facilitates maintenance. Individual liner segments may be replaced in the present invention without having to disrupt adjacent liner segments.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
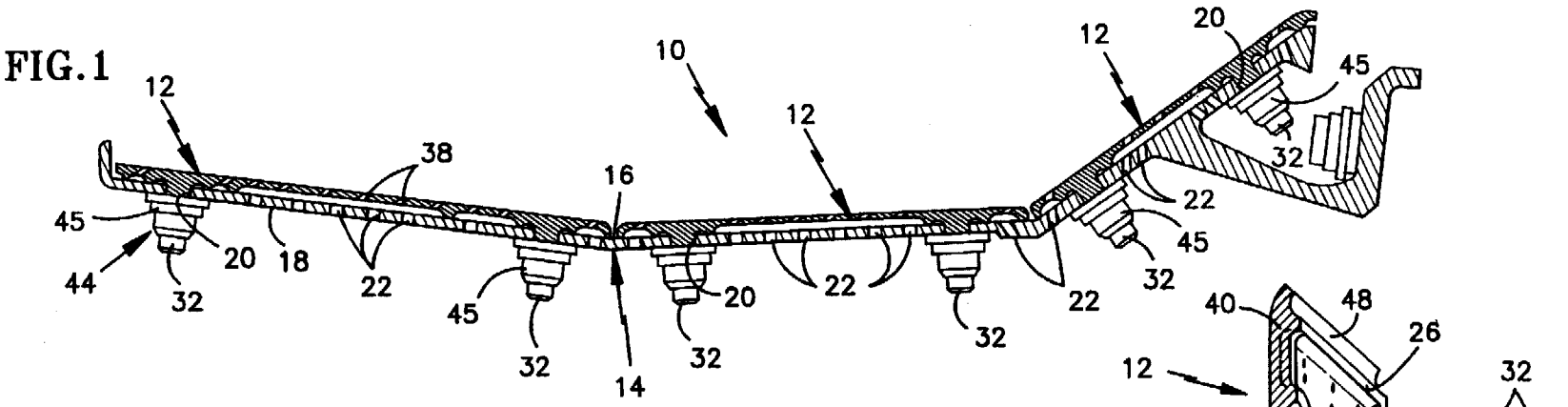
FIG. 1 is a diagrammatic partial view of a combustor.

Referring to FIG. 1, a combustor 10 for a gas turbine engine includes a plurality of liner segments 12 and a support shell 14. The support shell 14 shown in FIG. 1 is a cross-sectional partial view of an annular shaped support shell. Alternatively, the combustor 10 may be formed in other shapes, such as a cylindrical support shell (not shown). The support shell 14 includes interior 16 and exterior 18 surfaces, a plurality of mounting holes 20, and a plurality of second coolant holes 22 extending through the interior 16 and exterior 18 surfaces.

Figure 3:
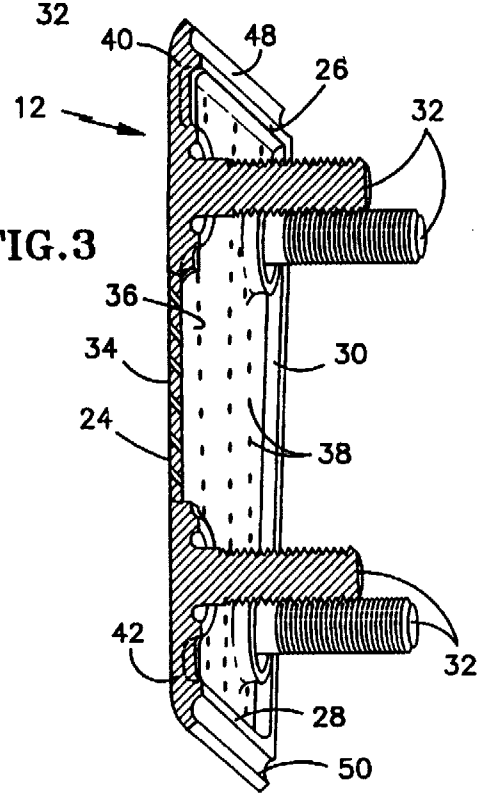
FIG. 3 is a cross-sectional view of the liner segment shown in FIG. 2 cut along section line 3—3.
Figure 2:
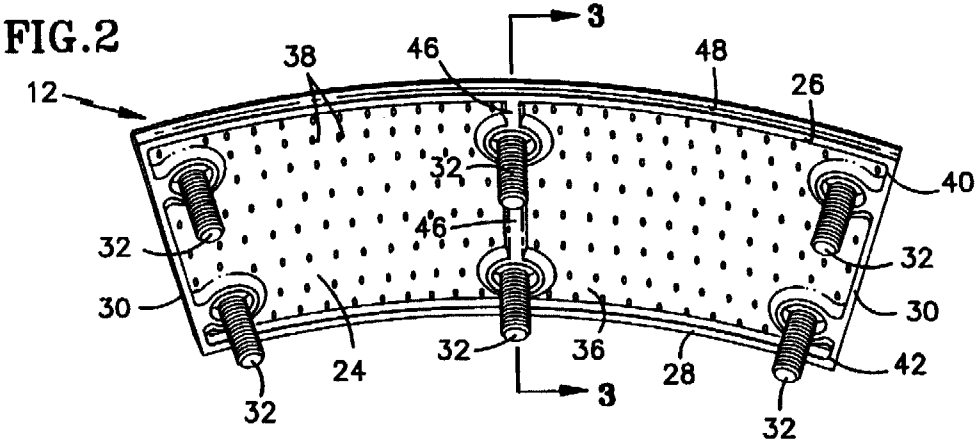
FIG. 2 is a perspective view of a liner segment.

Referring to FIGS. 2 and 3, each liner segment 12 includes a panel 24, a forward wall 26, a trailing wall 28, a pair of side walls 30, and a plurality of mounting studs 32. The panel 24 includes a face surface 34 (see FIG. 3) and a back surface 36, and a plurality of first coolant holes 38 extending therethrough. The forward wall 26 is positioned along a forward edge 40 of the panel 24 and the trailing wall 28 is positioned along a trailing edge 42 of the panel 24. The side walls 30 connect the forward 26 and trailing walls 28. The forward 26, trailing 28, and side walls 30 extend out from the back surface 36 a particular distance. The plurality of mounting studs 32 extend out from the back surface 36, and each includes fastening means 44 (see FIG. 1). In the preferred embodiment, the studs 32 are threaded and the fastening means 44 is a plurality of locking nuts 45.

Referring to FIG. 2, ribs which extend out of the back surface 36 of the panel 24 may be provided for additional structural support in some embodiments. The height of the rib 46 away from the back surface 36 of the panel 24 is less than that of the walls 26,28,30.

Referring to FIG. 3, a forward flange 48 extends out from the forward wall 26 and a trailing flange 50 extends out from the trailing wall 28. The forward 48 and trailing 50 flanges have arcuate profiles which facilitate flow transition between adjacent liner segments 12, and therefore minimize disruptions in the film cooling of the liner segments 12.

Each liner segment 12 is formed by casting for several reasons. First, casting permits the panel 24, walls 26,28,30, and mounting studs 32 elements of each segment 12 to be integrally formed as a one piece unit, and thereby facilitate liner segment 12 manufacturing. Casting each liner segment 12 also helps minimize the weight of each liner segment 12. Specifically, integrally forming the segment 12 elements in a one piece unit allows each element to draw from the mechanical strength of the adjacent elements. As a result, the individual elements can be less massive and the need for attachment medium between elements is obviated. Casting each liner segment 12 also increases the uniformity of liner segment 12 dimensions. Uniform liner segments 12 help the uniformity of the gaps between segments 12 and the height of segments 12. Uniform gaps minimize the opportunity for binding between adjacent segments 12 and uniform segment heights make for a smoother aggregate flow surface.

Referring to FIG. 1, in the assembly of the combustor 10, the mounting studs 32 of each liner segment 12 are received within the mounting holes 20 in the support shell 14, such that the studs 32 extend out on the exterior surface 18 of the shell 14. Locking nuts 45 are screwed on the studs 32 thereby fixing the liner segment 12 on the interior surface 16 of the support shell 14. Depending on the position of the liner segment 12 within the support shell 14 and the geometry of the liner segment 12, one or more nuts 45 may be left less tight than other stud/nut combinations to encourage liner segment 12 thermal growth in a particular direction. In all cases, however, the liner segment 12 is tightened sufficiently to create a seal between the interior surface 16 of the support shell 14 and the walls 26,28,30 (see FIGS. 2 and 3) of the segment liner 12.

Referring to FIG. 2, if the liner segment 12 does include ribs 46 for further structural support, the height of the rib 46 away from the back surface 36 of the panel 24 is less than that of the walls 26,28,30, thereby leaving a gap between the rib 46 and the interior surface 16 of the support shell 14. The gap permits cooling air to enter underneath the rib 46.

Although this invention has been shown and described with respect to the detailed embodiments thereof, it will be understood by those skilled in the art that various changes in form and detail thereof may be made without departing from the spirit and scope of the claimed invention.

We claim:

1. A combustor for a gas turbine engine, comprising:

a support shell, having an interior and an exterior surface, a plurality of mounting holes, and a plurality of second coolant holes extending through said support shell;

a plurality of liner segments, each segment having:

a panel, with a face surface and a back surface, said panel having a plurality of first coolant holes;

a forward wall;

a trailing wall;

a pair of side walls, connecting said forward and trailing walls, wherein said forward, trailing, and side walls extend out from said back surface a particular distance;

a plurality of mounting studs, extending out from said back surface, each having liner segment attachment means;

at least one rib, extending out of said back surface a distance less than that of said walls;

a forward flange, extending out from said forward wall;

wherein said forward flange includes an arcuate shape to minimize disruptions in film cooling fluid paths between adjacent liner segments;

wherein said liner segments are attached to said support shell interior surface by said mounting studs extending through said mounting holes and said liner segment attachment means acting against said exterior surface of said support shell;

wherein said walls space said panel a distance away from said support shell, and seal the gap between said panel and said support shell thereby preventing air normally traveling in said second coolant holes and out said first coolant holes from escaping between said walls and said support shell.

2. A segment for lining a combustor wall, comprising:

a panel, with a face surface and a back surface, said panel having a plurality of first coolant holes;

a forward wall;

a trailing wall;

a pair of side walls, connecting said forward and trailing walls;

wherein said forward, trailing, and side walls extend out from said back surface a particular distance;

a plurality of mounting studs, extending out from said back surface, each having segment attachment means;

at least one rib, extending out of said back surface a distance less than that of said forward, trailing, and side walls;

a forward flange, extending out from said forward wall;

wherein said forward flange includes an arcuate shape to minimize disruptions in film cooling fluid paths between adjacent segments, and therefore facilitate heat transfer.

3. A combustor for a gas turbine engine according to claim 1, further comprising:

a trailing flange, extending out from said trailing wall;

wherein said trailing flange includes an arcuate shape to minimize disruptions in film cooling fluid paths between adjacent segments.

4. A segment for lining a combustor wall according to claim 2, further comprising:

a trailing flange, extending out from said trailing wall;

wherein said trailing flange includes an arcuate shape to minimize disruptions in film cooling fluid paths between adjacent segments.

* * * * *